US005573369A

United States Patent [19]

Du

[11] Patent Number: 5,573,369

[45] Date of Patent: Nov. 12, 1996

[54] IMPELLER FOR VACUUM CLEANER WITH TAPERED BLADES

[75] Inventor: Wei Du, North Olmsted, Ohio

[73] Assignee: The Scott Fetzer Company, Westlake, Ohio

[21] Appl. No.: 555,116

[22] Filed: Nov. 8, 1995

[51] Int. Cl.[6] ..... F04D 29/66; F04D 29/30

[52] U.S. Cl. ..... 415/119; 415/206; 416/185; 416/223 B; 417/423.2

[58] Field of Search ..... 415/119, 200, 415/203, 204, 206, 207, 915; 416/182, 185, 188, 223 B, 241 A; 417/423.2, 423.14; 15/326

[56] References Cited

U.S. PATENT DOCUMENTS

| | | | |
|---|---|---|---|
| 1,214,812 | 2/1917 | Meredith-Jones . | |
| 1,233,115 | 7/1917 | Osborne . | |
| 1,548,082 | 8/1925 | Wise et al. | 417/423.2 |
| 2,036,056 | 3/1936 | Kroenlein . | |
| 2,101,390 | 12/1937 | Gorissen . | |
| 2,309,583 | 1/1943 | Frantz . | |
| 3,594,848 | 7/1971 | Atkinson | 415/204 |
| 4,338,062 | 7/1982 | Neal . | |
| 4,595,420 | 6/1986 | Williams, III et al. . | |
| 4,644,606 | 2/1987 | Luerkin et al. . | |
| 5,147,187 | 9/1992 | Ito et al. . | |
| 5,168,599 | 12/1992 | Williams . | |
| 5,224,821 | 7/1993 | Ozawa . | |
| 5,257,903 | 11/1993 | Allmon et al. . | |

FOREIGN PATENT DOCUMENTS

| | | | |
|---|---|---|---|
| 0040808 | 3/1977 | Japan | 416/185 |

OTHER PUBLICATIONS

W. Neise, "Review of Noise Reduction Methods for Centrifugal Fans," *Journal of Engineering for Industry,* May, 1982, vol. 104, pp. 151–153.

*Primary Examiner*—Edward K. Look
*Assistant Examiner*—Christopher Verdier
*Attorney, Agent, or Firm*—Jones, Day, Reavis & Pogue

[57] ABSTRACT

A fan for a vacuum cleaner has a fan housing, a motor and an impeller. The fan housing has an inlet, an outlet, a scroll-shaped side wall, a back wall and a flat front wall. The impeller has a hub and multiple blades. The blades have a leading edge that is tapered upward, a top edge that is tapered downward, and a trailing edge that is tapered downward. Such tapering of the top edge and trailing edge provides less noise and better durability without diminishing air performance.

6 Claims, 3 Drawing Sheets

IMPELLER FOR VACUUM CLEANER WITH TAPERED BLADES

BACKGROUND OF THE INVENTION

The present invention relates to the field of vacuum cleaner fans. In conventional vacuum cleaners, a fan drives dirt laden air into a filter bag. There are two common vacuum cleaner configurations. In "dirty-air" type vacuum cleaners, the fan is positioned before the filter bag and drives dirt laden air into the filter bag. In "clean air" type vacuum cleaners, the fan is positioned after the filter bag and sucks clean air out of the filter bag.

FIGS. 1, 2A and 2B show a conventional dirty-air vacuum cleaner 10. A fan 12 drives air from a floor nozzle 14 to a filter bag via a fill tube 18. Dirt removed from the floor by the airflow is thus filtered out and deposited into the filter bag 16.

The fan 12 comprises a motor 20, a housing 22, and an impeller 24. The motor 20 is connected to the back of the housing 22 and rotates the impeller 24 via a shaft 26. The resulting centrifugal force draws air into an inlet 28 and out through an outlet 30. The housing comprises a back wall 32, a substantially flat front wall 34, a volute 36 (scroll-shaped side wall), and a cutoff 38. As air is swept around the housing 22 by the impeller 24, the air fills the continually growing gap between the impeller 24 and the volute 36 until it is redirected to the outlet 30 by the cutoff 38.

FIGS. 3A and 3B are detailed views of an impeller 24 of the type commonly used in dirty-air vacuum cleaners. The impeller 24 comprises a hub 42 supporting a backplate 44 which supports multiple blades 46. The hub 42 has a bore 48 for mounting onto the motor shaft 26. Each blade 46 has a leading edge 50, a top edge 52, and a trailing edge 54. The entire impeller 24 is usually molded from plastic.

Conventional impellers for dirty-air fans typically include a number of design features which are engineered into the impeller design to improve air performance (i.e. performance in terms of suction and airflow) and reduce fan noise. The empty area between hub 42 and blades 46 is called the "eye" 49 and provides more space for air entering the inlet 28. The leading edge 50 is sloped upward to streamline airflow where it first encounters the blade 46. The backplate 44 is curved, as shown, to soften the airflow's right angle turn when it first hits the backplate from the inlet 28. The blades 46 are generally not aligned radially but are rather backswept relative to the rotational direction and are typically curved.

In conventional impellers for dirty-air fans, the top edge 52 of the blade 46 is substantially parallel to the front wall 34. So if the front wall 34 is flat and perpendicular to the shaft 26, as is typical, the top edge 52 is also perpendicular to the shaft 26. Similarly, the trailing edge 54 is substantially parallel to the volute 36. So if the volute is generally parallel to the shaft 26, as is typical, the trailing edge 54 is also parallel to the motor shaft. Hence, if the front wall 34 is perpendicular to the volute 36, as is typical, then top edge 52 is perpendicular to trailing edge 54.

In order to establish the airflow required for removing dirt, the impeller must rotate at high speed, typically 10,000–20,000 RPM. The strong centrifugal force acting on the impeller's mass applies several stresses to the impeller: the curved backplate is stressed, causing it to straighten out and pull away from the blades; the blade curvature is stressed to horizontally straighten out; and the backswept blades are stressed to tip over onto the backplate. The repeated on-off application of these stresses can produce damage such as: stress cracks in the backplate; weakening of the joint between the blade and backplate; gradual deformation of the blade shape; and fatigue the material. All this stress damage degrades air performance and impeller durability, in addition to increasing the noise level.

Besides stress-related damage, there is also impact damage. The blades can become chipped, usually at their trailing edge 54, by small hard objects picked up by the vacuum cleaner which hit the impeller with a violent impact.

Dirty-air fans tend to be loud due to air turbulence within the housing. Also, the repetitive passing of the trailing edges 54 past the cutoff 38 produces a siren effect. Within the fan housing, the cutoff 38 represents the region of smallest clearance between the volute 36 and the impeller 24. As each blade passes the cutoff 38, a pressure pulse is generated which produces a sound. The pitch of the sound is at a frequency corresponding to the rate of blade passage past the cutoff. This frequency is called the "blade-passing frequency."

Applicant has observed several performance-related factors in connection with a standard impeller, i.e. impeller no. MO-118978, used in many Kirby vacuum cleaners. The dimensions of this impeller type are as follows: there are 11 blades standing vertical from a curved backplate; the backplate's outer diameter is 121 mm; the blade's top edge is within a horizontal plane (i.e. taper of 0 degrees), and is 21 mm high (measured from the backplate's outer edge); the blades' leading edges intersect the backplate at 23 mm from the hub center, and are tapered at 45 degrees from vertical; the blades' trailing edges are vertical (i.e. zero taper) and intersect the backplate essentially at the backplate's outer edge; the backsweep of the curved blade, measured relative to radial, is 45 degrees at the leading edge and 37 degrees at the trailing edge.

The impeller resides within a standard Kirby G4 model fan housing having dimensions as follows: the front face is horizontal and is 28 mm from the back face; the inlet diameter is 50 mm; the clearance between the blades' top edges and the housing's front face is uniformly 4 mm; the volute is vertical in one dimension and has a radius that increases from 63 mm on one side of the cutoff to 110 mm just after the cutoff; the clearance between the blade's trailing edge and the volute is 3 mm at the cutoff and increases by about 7.4 mm for each ¼ rotation away from the cutoff.

The standard fan, having the aforementioned dimensions, produces maximum suction of 28 inches of water, maximum airflow of 110 CFM, produces 94 dBA noise pressure level (measured from 3 feet away) when the cleaner is used in a 15,000 RPM "shampooer mode" and 80 dBA when normally 12,000 RPM while vacuuming plush carpet. In a standard "shrapnel impact" test (where nuts, bolts, pennies, washers and bobby pins are sucked into the cleaner's suction hose), the standard impeller typically tends to crack after 400 impacts on average.

SUMMARY OF THE INVENTION

In view of the above-indicated drawbacks and disadvantages, there is therefore a need for an impeller which is more resistant to stress-related fatigue damage.

There is also a need for an impeller which is more resistant to impact damage.

There is also a need for an impeller which operates more quietly.

There is also a need for an impeller which satisfies the above needs without a reduction in air performance.

The above needs are satisfied by fan assembly of the present invention, which includes a fan motor having a shaft, and a fan housing having a front wall, a back wall and a volute, an inlet for receiving air, an outlet for discharging air. An impeller is mounted to said shaft and retained within said fan housing. The impeller centrifugally creates an airflow which draws air in through the inlet and driving air out through the outlet.

The impeller includes a hub for connecting to said shaft, a backplate formed integrally with the hub, and a plurality of blades, formed integrally with the backplate and the hub. Each of said blades has a top edge substantially proximate to the front wall of the fan housing, and a trailing edge substantially proximate to the volute. One of said edges is tapered so as to be non-parallel with the housing and thereby define a non-uniform air passage between the impeller and the fan housing. This configuration of the impeller and fan housing is effective in muffling any generated sound.

The above and other needs which are satisfied by the present invention will become apparent from consideration of the following detailed description of the invention as is illustrated in the accompanying drawings.

DETAILED DESCRIPTION OF THE INVENTION

Figure 1:
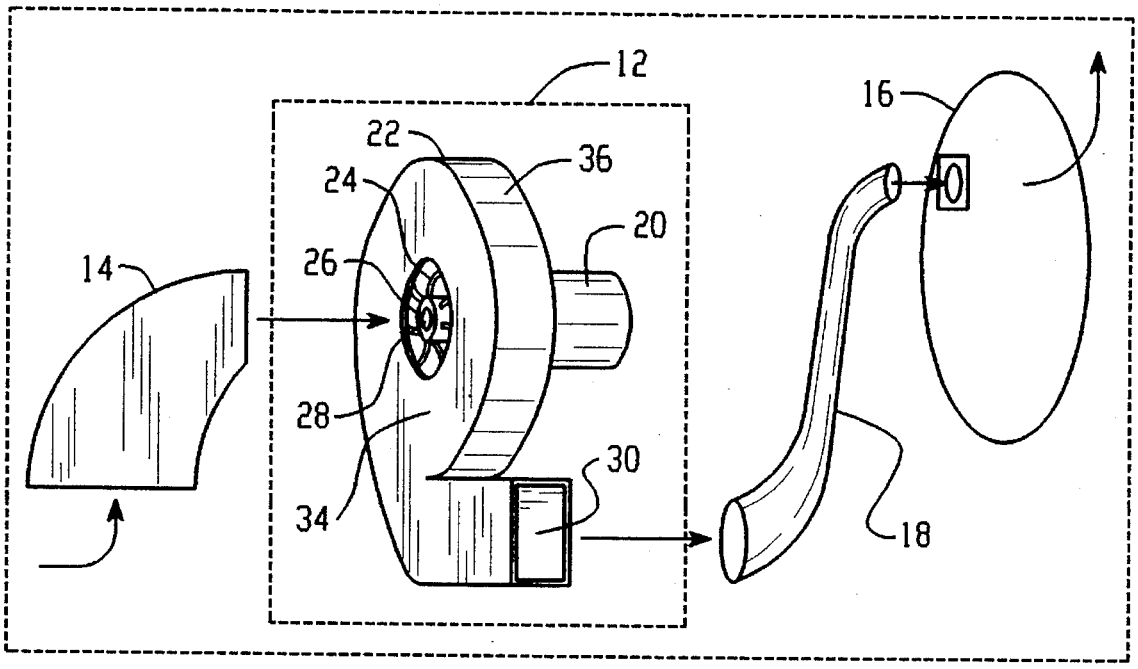
FIG. 1 (PRIOR ART)
FIG. 1 is a schematic view of a conventional dirty-air type vacuum cleaner assembly.
Figure 2A:
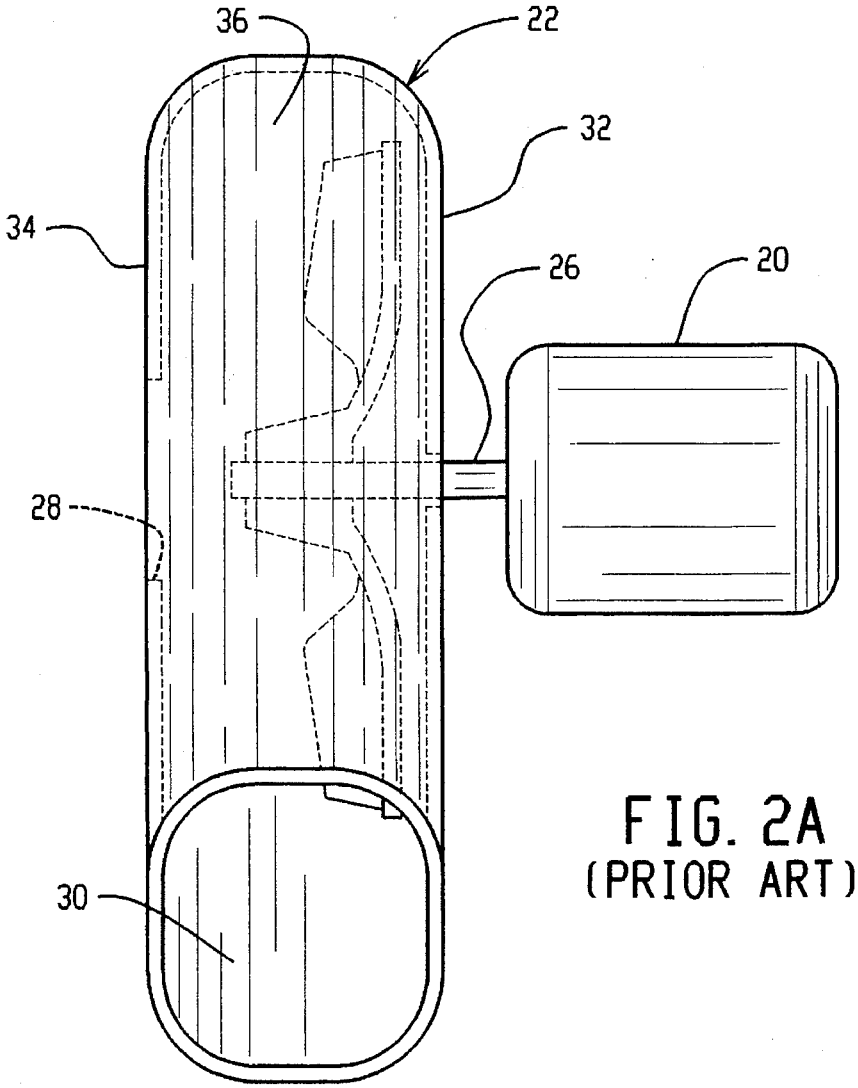
FIG. 2A (PRIOR ART)
FIGS. 2A and 2B are respective side and frontal views illustrating a conventional tangential-flow fan and its principal of operation.
Figure 2B:
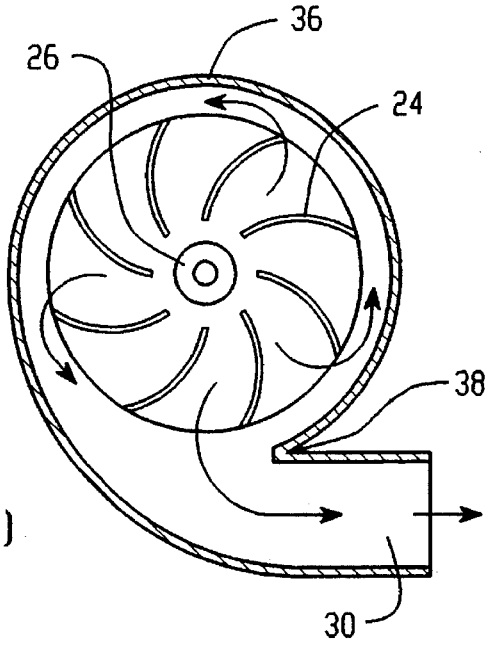
FIG. 2B (PRIOR ART)
Figure 3A:
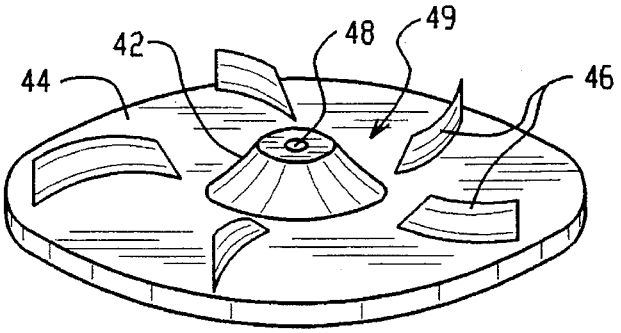
FIG. 3A (PRIOR ART)
FIGS. 3A and 3B are respective perspective and cutaway side views illustrating a conventional impeller.
Figure 3B:
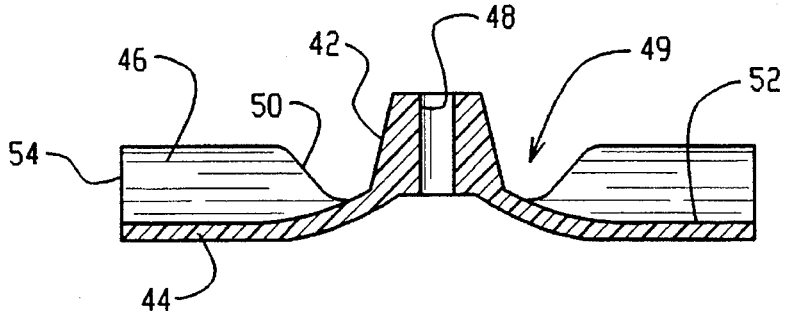
FIG. 3B (PRIOR ART)
Figure 4:
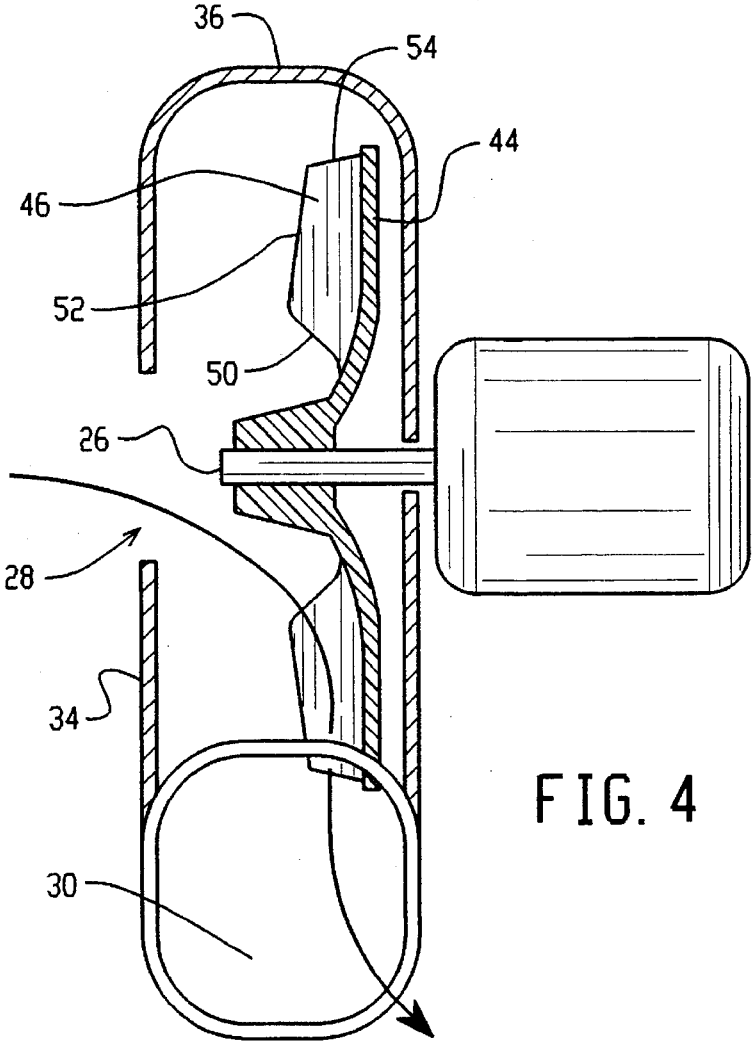
FIG. 4 is a cutaway side view of the fan according to the present invention.

The fan according to the present invention is molded from a rigid plastic such as polycarbonate. As shown in FIG. 4, according to the present invention, the blades 46 of the impeller 24 are tapered downward at the top edge 52 and tapered downward at the trailing edge 54 (technically termed "raked"), while front wall 34 is flat and perpendicular to both shaft 26 and volute 44. We define herein "vertical" as parallel with the shaft, "horizontal" as perpendicular (or normal) to the shaft, "radial" as emanating horizontally from the motor shaft, "upward" as the vertical direction from the backplate toward the front face, and "downward" being the opposite direction of "upward".

In the preferred embodiment, the leading edge is tapered at an angle to the leading edge/backplate intersection relative to horizontal. The taper of the trailing edge is preferably measured as an angle at the trailing edge/top edge intersection relative to horizontal.

Applicant has found that the optimum balance in between noise relative to air performance is achieved with an impeller having a blade with a taper of: 5–20 degrees on the top edge (preferably 10–15 degrees) so that the blade decreases in width in the radial direction of the impeller; and 5–20 degrees on the trailing edge (preferably 10–15 degrees) so that the blade decreases in length in the axial direction parallel to the shaft. In an impeller having the top edge and trailing edge are tapered in this way, the noise drops 5 dBA in shampooer mode and 1 dBA when normally vacuuming carpet while the maximum suction (at shutoff condition) is reduced by only 2.5 inches water and the maximum airflow (at fully open condition) drops by only 5 CFM. The cleaning effectiveness (based on the amount of sand and talc cleaned from carpet according to a standard industry test procedure) is not measurably affected. In the shrapnel impact test, the impeller withstands twice the typical number of impacts (800 on average) before cracking.

An impeller with a tapered top edge and trailing edge as mentioned above (tapering each by 10–15 degrees) significantly reduces noise and increases impact resistance, while negligibly reducing air performance and not reducing cleaning effectiveness at all. Applicant believes this to be caused by the fact that the clearance between the top edge and front wall is not uniform, and thus noise created by airflow turbulence in that clearance region is smeared and muffled. Similarly, the clearance between the trailing edge and volute is not uniform and so noise created by airflow turbulence in that clearance region is also smeared and muffled. Being tapered, a smaller portion of the trailing edge passes near the cutoff, thus lessening the siren effect.

The present impeller has reduced mass, thus lessening the stresses on the impeller body. Each gram of the impeller's mass contributes to centrifugal stress proportionately to how far it is from the hub. Hence, since the taper of the blade preferentially removes the blade material farthest from the hub, the impeller of the present invention greatly reduces fatigue due to centrifugal stress.

The impeller is also less susceptible to impact damage by hard objects, since the smaller profile (due to tapering) presents a smaller target. More importantly, considering the blade as a cantilever protruding from the backplate, the tapering of the blade reduces its moment arm, rendering it stiffer and more resistant to impact breakage. The reduced blade dimensions also reduce weight, material cost, and manufacturing cost.

The aforementioned advantages are achieved by the impeller having tapered blades, as according to the present invention, substantially with negligible degradation in air performance. This is due to the fact that the material removed by tapering contributes substantially to noise, fatigue and impact damage, but contributes negligibly to air performance.

The foregoing description of the preferred embodiment has been presented for purposes of illustration and description. It is not intended to be limiting insofar as to exclude other modifications and variations such as would occur to those skilled in the art. Any modifications such as would occur to those skilled in the art in view of the above teachings are contemplated as being within the scope of the invention as defined by the amended claims.

I claim:

1. A fan assembly for a vacuum cleaner comprising:

a fan motor having a shaft;

a fan housing having housing surfaces including a front wall, a back wall and a volute, and also an inlet for receiving air, an outlet for discharging air;

an impeller mounted to said shaft and retained with said fan housing, said impeller centrifugally creating an airflow which draws air in through the inlet and driving air out through the outlet, said impeller comprising;

a hub for connecting to said shaft;

a backplate formed integrally with the hub;

a plurality of blades, formed integrally with the backplate and the hub, wherein each of said blades has a straight top edge substantially proximate to the front wall of the fan housing, and a straight trailing edge substantially proximate to the volute, wherein each of said edges are tapered so as to be non-parallel with the respective housing surface and thereby define a non-uniform air passage between the impeller and the fan housing, which effectively muffles any generated sound.

2. The fan of claim 1 wherein the tapered edge of each impeller blade is tapered 5–20 degrees.

3. The fan of claim 2 wherein the tapered edge of each impeller blade is tapered 10–15 degrees.

4. The fan of claim 1 wherein the front wall of the fan housing is substantially flat and in a plane substantially perpendicular to the direction of the shaft and wherein the top edge is tapered so that the width of each blade decreases in the radial direction of the impeller so as to define a non-uniform air passage between the impeller and the front wall of the fan housing.

5. The fan of claim 1 wherein the volute of the fan housing is substantially parallel to the direction of the shaft, and wherein the trailing edge is tapered so that the length of each blade decreases in the axial direction parallel to the shaft, so as to define a non-uniform air passage between the impeller and the volute of the fan housing.

6. The fan of claim 1 wherein the impeller is molded from a plastic material.

* * * * *